US008079627B2

(12) United States Patent
Lutzhöft et al.

(10) Patent No.: US 8,079,627 B2
(45) Date of Patent: Dec. 20, 2011

(54) DEVICE FOR VERTICALLY HOLDING PIPES

(75) Inventors: Jens Lutzhöft, Hamburg (DE); Jörn Grotherr, Halstenbek (DE); Ronaldus R. M. Rölling, Hamburg (DE); Iwo Severin, Lübeck (DE)

(73) Assignee: Blohm + Voss Repair GmbH, Hamburg (DE)

( * ) Notice: Subject to any disclaimer, the term of this patent is extended or adjusted under 35 U.S.C. 154(b) by 493 days.

(21) Appl. No.: 12/226,642

(22) PCT Filed: Feb. 14, 2007

(86) PCT No.: PCT/DE2007/000266

§ 371 (c)(1),
(2), (4) Date: Oct. 24, 2008

(87) PCT Pub. No.: WO2007/124706

PCT Pub. Date: Nov. 8, 2007

(65) Prior Publication Data

US 2009/0152409 A1 Jun. 18, 2009

(30) Foreign Application Priority Data

Apr. 28, 2006 (DE) ..... 10 2006 020 337

(51) Int. Cl.
*E21B 19/06* (2006.01)

(52) U.S. Cl. ..... 294/90

(58) Field of Classification Search ..... 294/90, 294/102.1, 102.2, 119.2
See application file for complete search history.

(56) References Cited

U.S. PATENT DOCUMENTS

| | | | | |
|---|---|---|---|---|
| 1,460,652 | A * | 7/1923 | Harris | 294/90 |
| 1,486,471 | A * | 3/1924 | Wilcox | 294/90 |
| 1,599,144 | A * | 9/1926 | Paulsen | 294/90 |
| 1,856,636 | A | 12/1930 | Hoffoss | |
| 2,392,462 | A * | 1/1946 | Coe | 294/90 |
| 2,957,724 | A * | 10/1960 | Bujold | 294/102.2 |
| 3,884,519 | A * | 5/1975 | McFadden | 294/90 |
| 4,035,012 | A | 7/1977 | Guier | |
| 7,434,614 | B2 * | 10/2008 | Nelson et al. | 166/77.52 |

FOREIGN PATENT DOCUMENTS

| | | |
|---|---|---|
| DE | 19 38 457 | 2/1970 |
| DE | 693 05 824 | 3/1997 |
| GB | 249 807 | 12/1926 |

* cited by examiner

*Primary Examiner* — Dean Kramer
(74) *Attorney, Agent, or Firm* — Lucas & Mercanti, LLP; Klaus P. Stoffel

(57) ABSTRACT

A device for vertically holding pipes, which includes a base element in the form of a segment of a cylinder, a door element pivotably connected to the base element by at least one pivot joint, and a fastener assembly mounted opposite the pivot joint. The fastener assembly has a pivotable catch with a locking profile that, when in the locked state, grips a locking pin from behind. A safety pin and a safety plate are located in the area of the pivotable catch, and, depending on its position, the safety plate releases or closes at least one opening for the safety pin.

24 Claims, 12 Drawing Sheets

DEVICE FOR VERTICALLY HOLDING PIPES

BACKGROUND OF THE INVENTION

The invention pertains to a device for vertically holding pipes, which comprises a base element in the form of a segment of a cylinder, a door element pivotably connected to the base element by at least one pivot joint, and a fastener assembly mounted opposite the pivot joint.

These types of devices are used, for example, to help manage drill pipes on offshore drilling platforms. The drill pipes surround the bit and are lowered from the drilling platform. Drill pipes typically consist of a large number of pipe segments connected to each other to form a string. The individual pipe segments are connected one by one to the drill pipe already being held by the drilling platform and then, after the connecting procedure has been completed, they are lowered from the platform. To conduct the holding and lowering procedures, special devices are required to prevent the pipe from slipping out and thus sinking into the sea.

In a normal application, the door element of the device is opened and then typically pushed laterally over the pipe to be held. The door element is shut, and then the fastener assembly is locked to guarantee that the pipe will be held securely.

If the operating crew believes that the fastener assembly is reliably locked and then proceeds to use the device to hold the pipe even though the fastener assembly is not in fact properly locked, the drill pipe will slip out, and in the least favorable case the entire drill pipe will be lost.

To avoid incidents such as this, display elements are already known, which are used to indicate that the fastener assembly has been properly locked. Because of the large number of conceivable operating situations, however, these elements do not offer the necessary reliability.

SUMMARY OF THE INVENTION

The object of the present invention is to design a device of the type described above in such a way that a reliable signal is given to indicate that the fastener assembly of the device has been properly locked.

This object is achieved according to the invention in that the fastener assembly has a pivotable catch, the locking profile of which, in the locked state, grips a locking pin from behind; in that, in the area of the pivotable catch, a safety pin and a safety plate are arranged; and in that the safety plate, as a function of its position, either releases or closes an opening for the safety pin.

Through the combination of the inventive functional components, many conceivable incorrect states which can occur during the use of the device can be detected. The safety pin gives the signal that the device has been properly locked. The safety pin can be moved into the intended lowered position only after all the components of the device have assumed the positions necessary for proper locking.

If an incorrect state is present, the safety pin projects out from the device and can be easily seen or felt by hand. Even under the least favorable weather conditions or under conditions of poor visibility, therefore, the operator can detect the position of the safety pin and determine whether or not the device has been properly locked.

A typical application consists in that the base element and the door element with the fastener assembly are provided for use on oil drilling platforms.

It is envisioned in particular that the base element and the door element with the fastener assembly will be designed to hold drill pipes.

A high degree of mechanical stability is obtained by using the base element to hold the locking pin.

The device can be operated more easily if the door element is used to hold the safety pin and the safety plate.

A compact design can be obtained, furthermore, by mounting both the locking profile and the safety plate so that they can pivot relative to a secondary axis.

A first guide for the safety pin is provided in that one of the openings for the safety pin is located in a carrier plate, which supports the fastener assembly, this plate being connected rigidly to the door element.

A second variably positionable guide for the safety pin is obtained by providing an opening for the safety pin in a support plate, which is connected to the locking profile and holds a grip, this support plate being mounted so that it can rotate relative to a central axis.

Typical operating procedures are made easier by the ability of the support plate to move into different positions as a function of the closing state present at the time in question.

Many incorrect closing positions can be easily detected because of the ability of the safety plate to move into different positions as a function of the relative positioning between the base element and the door element.

According to one embodiment, the safety plate is mounted so that it is free to pivot.

It is also envisioned that the safety plate is mounted so that it can shift position.

So that the shut state of the door element can be detected, it is proposed that a stop block be provided on the base element to position the safety plate. Connecting the grip to the locking profile by a connecting profile, which is held by the support plates, facilitates manual actuation.

Designing the grip as a pivoted lever facilitates actuation under harsh working conditions.

It is also envisioned that the grip can be designed as a pull-handle.

Using the pipe being held by the device to position the safety pin automatically reduces the number of manual operations required.

The holding device as a whole can be positioned more easily if the base element is provided externally with at least one retaining element.

It has been found advantageous for the base element to comprise two retaining elements, arranged opposite each other, which makes it possible in particular for the device to be tilted.

Designing each of two the retaining elements in the form of two web-like projections a certain distance apart makes it easier to establish positive-locking contact with a positioning element.

Arranging the two retaining elements one above the other in the longitudinal direction makes it possible to introduce torsional forces more effectively during the execution of a positioning procedure.

It also becomes easier to execute rotational or tilting movements by providing at least certain areas of the retaining elements with rounded external contours.

Forces can be introduced more effectively during the execution of positioning movements if at least certain parts of the retaining elements are provided with contact surfaces by which connection with a positioning element can established.

Providing the retaining elements with at least one opening makes it easier to ensure secure contact with the positioning elements.

If the opening in the area of the carrier plate and the opening in the area of the support plate are coaxial to each other, one being directly above the other, and if the openings are released by the safety plate in this operating state, it will be possible to introduce the safety pin properly only after the device has been closed correctly.

BRIEF DESCRIPTION OF THE DRAWING

Exemplary embodiments of the invention are illustrated in the drawings.

DETAILED DESCRIPTION OF THE INVENTION

Figure 1:
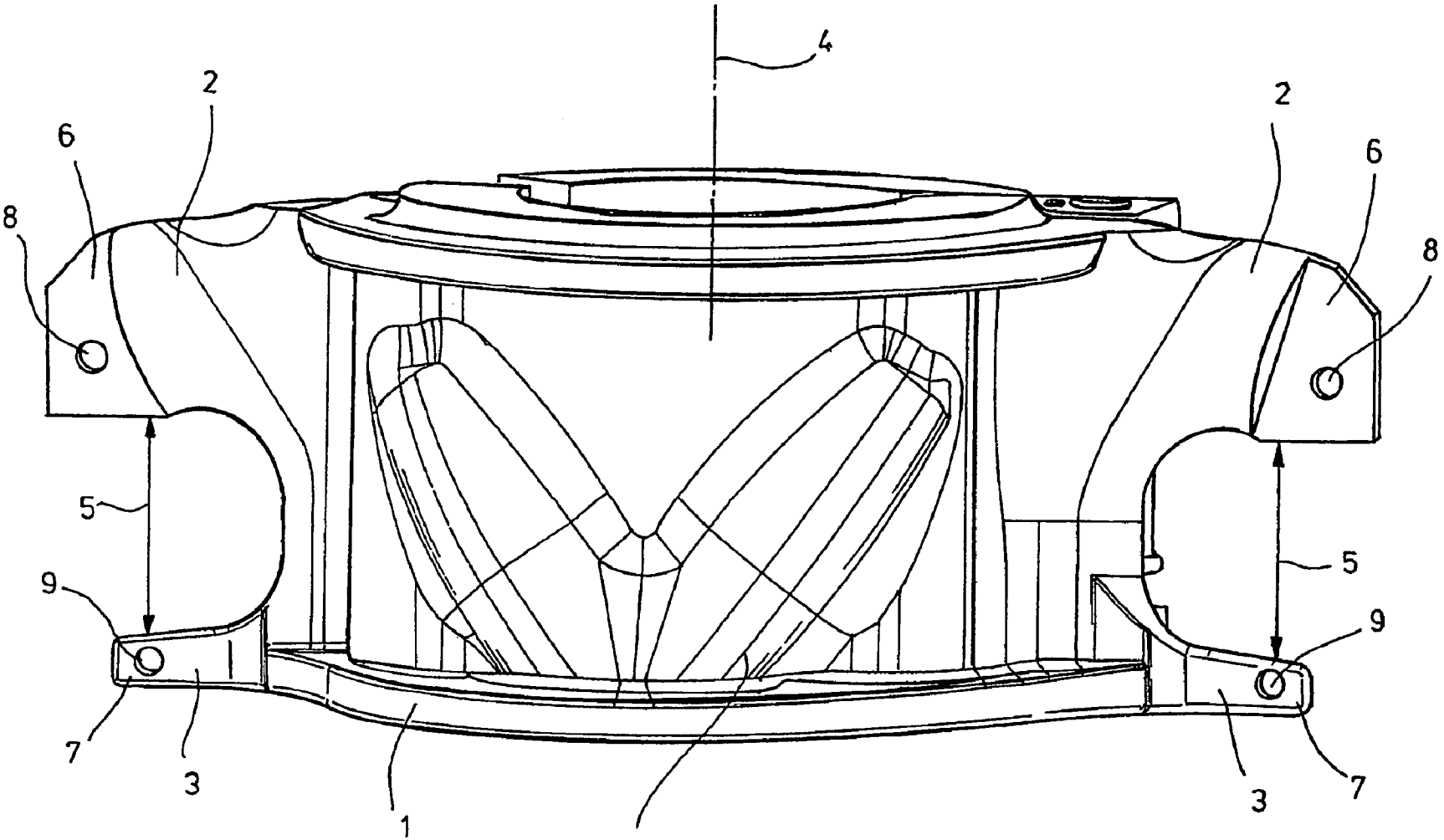
FIG. 1 shows a side view of the device, looking at the base element.

FIG. 1 shows a perspective side view of the device for vertically holding pipes. A base element 1 in the form of a segment of a cylinder can be seen, which is provided on each of its two opposite sides with two retaining elements 2, 3. The retaining elements 2, 3 are designed as projections and are provided with a rounded external contour. The retaining elements 2, 3 are a certain distance 5 apart in the longitudinal direction 4 of the base element 1.

Each of the retaining elements 2, 3 has an essentially flat contact surface 6, 7, which is machined into the rounded external contour. An opening 8, 9 is located in the area of each of these contact surfaces 6, 7. To provide the necessary rigidity, the base element 1 comprises stiffening ribs 10 on the outside.

Figure 2:
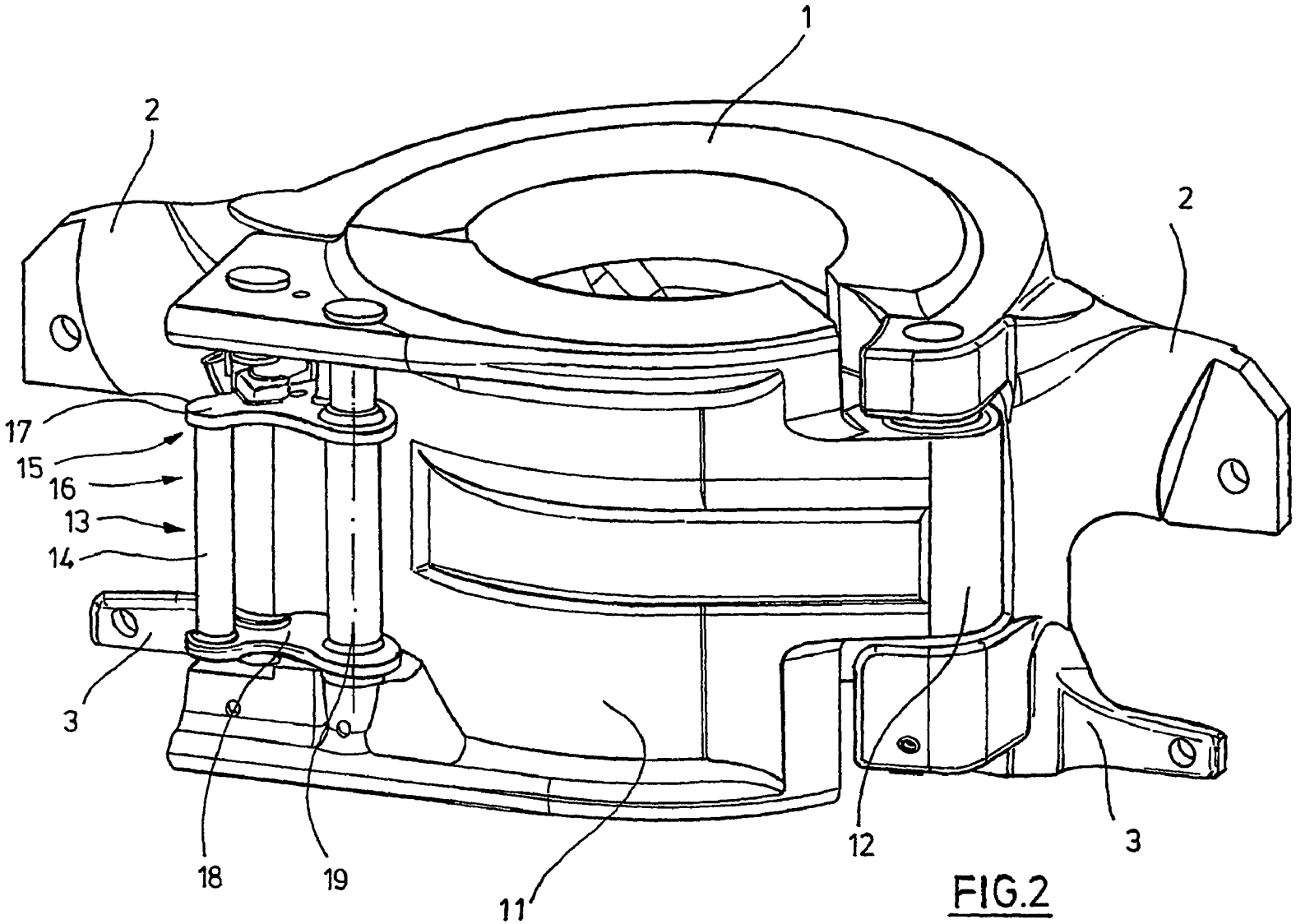
FIG. 2 shows a perspective side view of the device looking at the partially opened door element.

FIG. 2 shows another perspective view of the device, but, in contrast to FIG. 2, the view is toward a door element 11. It can be seen that the door element 11 is connected to the base element 1 by a pivot joint 12. At a point opposite the pivot joint 12, the door element 11 has a fastener assembly 13. The fastener assembly 13 is provided with a grip 14 and a locking profile 15. The fastener assembly 13 is mounted on the door element 11. In the closed state, the locking profile 15 grips a locking pin 16 from behind, the locking pin being mounted on the base element 1.

The grip 14 and the locking profile 15 are connected to each other by support plates 17, 18 and other components, which are to be explained in greater detail below. The support plates 17, 18 are mounted so that they can pivot relative to a central axis 19 of the fastener assembly 13.

Figure 3:
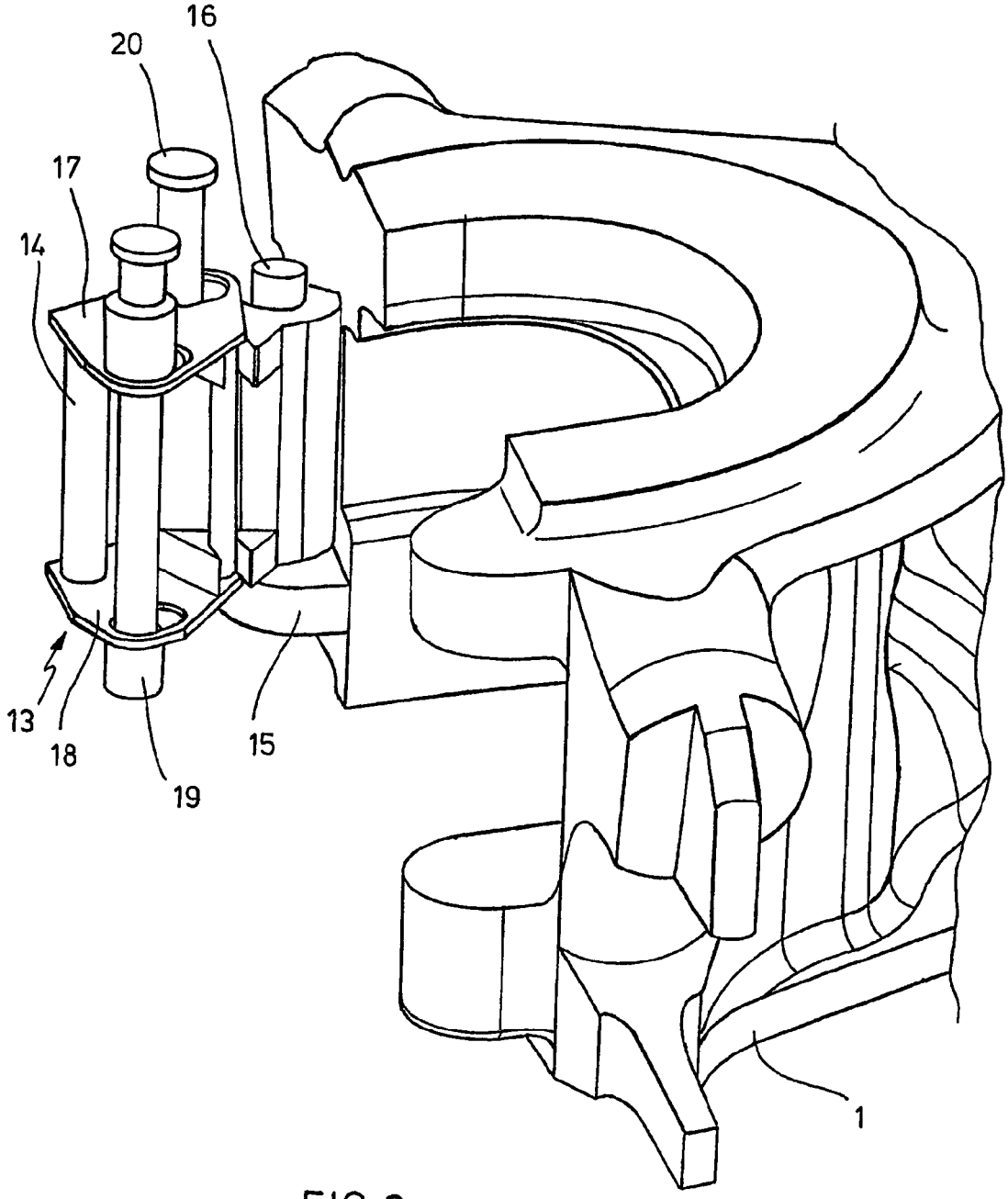
FIG. 3 shows a perspective view of the base element with its associated fastener assembly but without the door element.

FIG. 3 shows a perspective view of the base element 1 with its associated fastener assembly 13 but without the door element 11. It can be seen in particular that a large area of the locking profile 15 grips the locking pin 16 from behind. This provides a large contact surface, which is suitable for transmitting strong closing forces. The locking profile 15 has the shape of a segment of a cylinder and extends along a significant portion of the length of the locking pin 16. A secondary axis 20 can also be seen, the function of which will be explained in greater detail further below. The locking profile 15 is mounted so that it can pivot relative to the secondary axis 20. when the grip 14 pivots relative to the primary axis 19, a connecting profile held by the support plates 17, 18 engages in an opposing profile of the locking profile 15 and thus causes the locking profile 15 to pivot. In the exemplary embodiment shown here, the connecting profile is designed as a round pin, which engages in a groove-shaped opposing profile in the locking profile 15.

Figure 4:
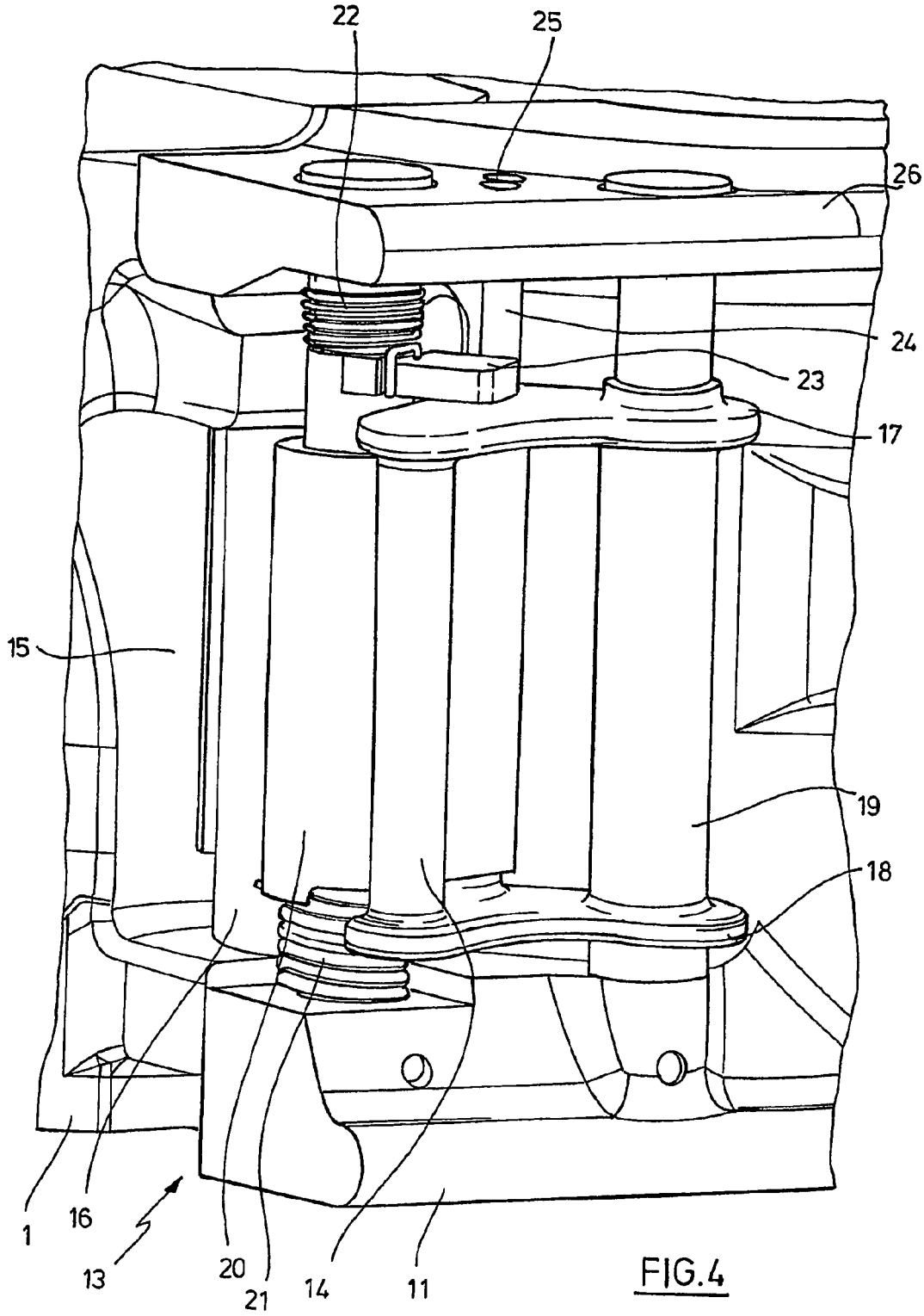
FIG. 4 shows an enlarged, partial view of the device in the area of the fastener assembly.

FIG. 4 shows a perspective view of the design of the fastener assembly 13 with more details. In the background, we can see the locking pin 16, held by the base element 1. In the foreground, we see part of the door element 11, which holds the central axis 19 and the secondary axis 20. We can also see the grip 14 held by the support plates 17, 18. In the position shown here, the locking profile 15 is gripping the locking pin 16 from behind. The locking profile 15 is mounted so that it can pivot relative to the secondary axis 20.

We can see in particular that a primary spring 21 and a secondary spring 22 are located in the area of the secondary axis 20. The primary spring 21 has the job of pushing the fastener assembly 13 into the locked position without the help of actuating forces. The secondary spring 22 pushes a safety plate 23 into a base position.

It can also be seen in FIG. 4 that a safety pin 24 has assumed a lowered position and does not project out of an opening 25 in a carrier plate 26. This position characterizes the proper position of the fastener assembly 13 in the locked position.

Figure 5:
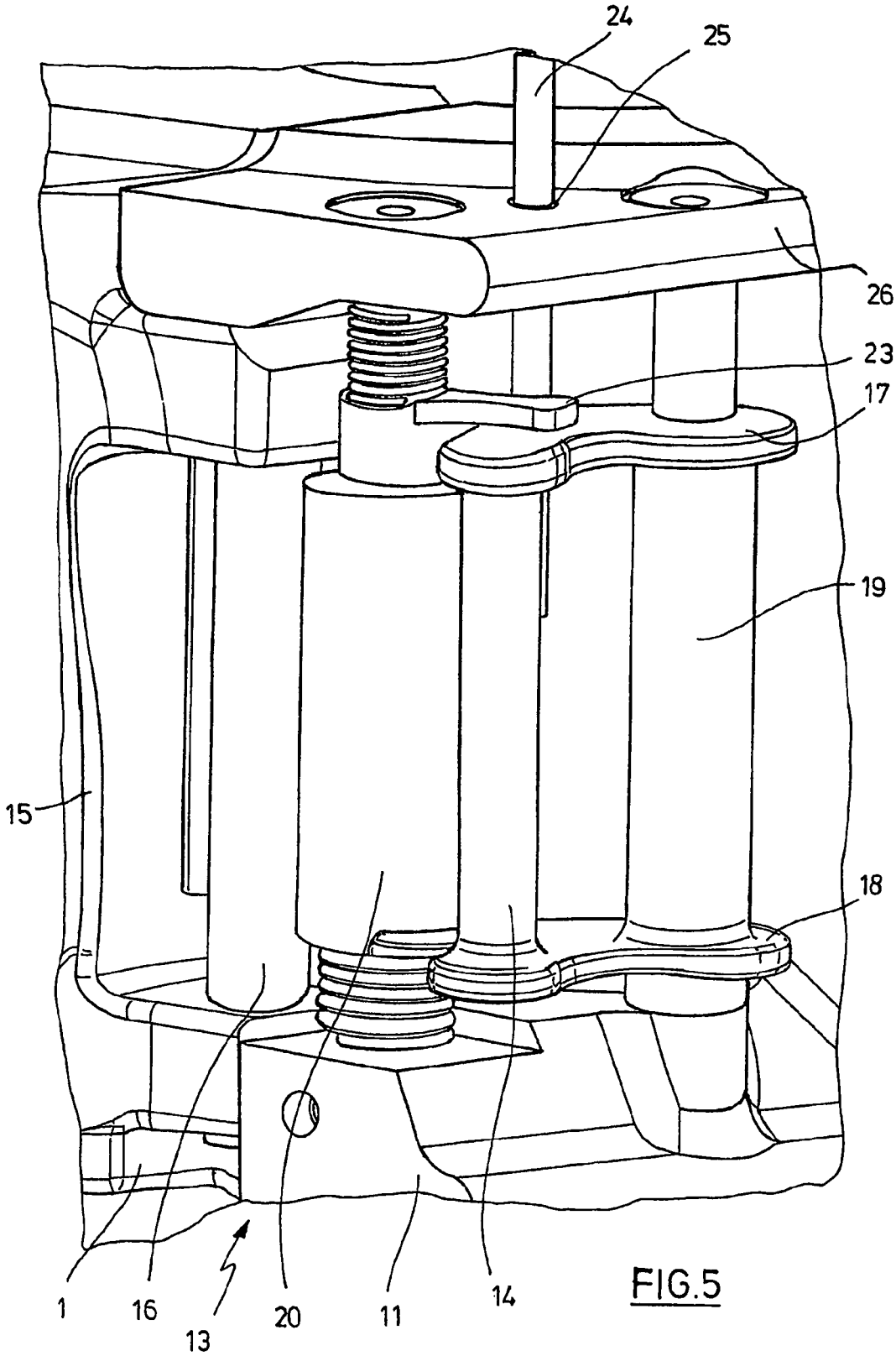
FIG. 5 shows a view similar to that of FIG. 4 with the components in different positions.

FIG. 5 shows the arrangement according to FIG. 4 with a safety pin 24, which projects out of the opening 25 in the carrier plate 26. This position characterizes an operating state of the fastener assembly 13 in which at least one component is not precisely occupying its intended closed position. Under certain conditions, the operating state shown in FIG. 5 is also assumed while the safety pin 24 is being introduced into the openings and guides provided for it.

Figure 6:
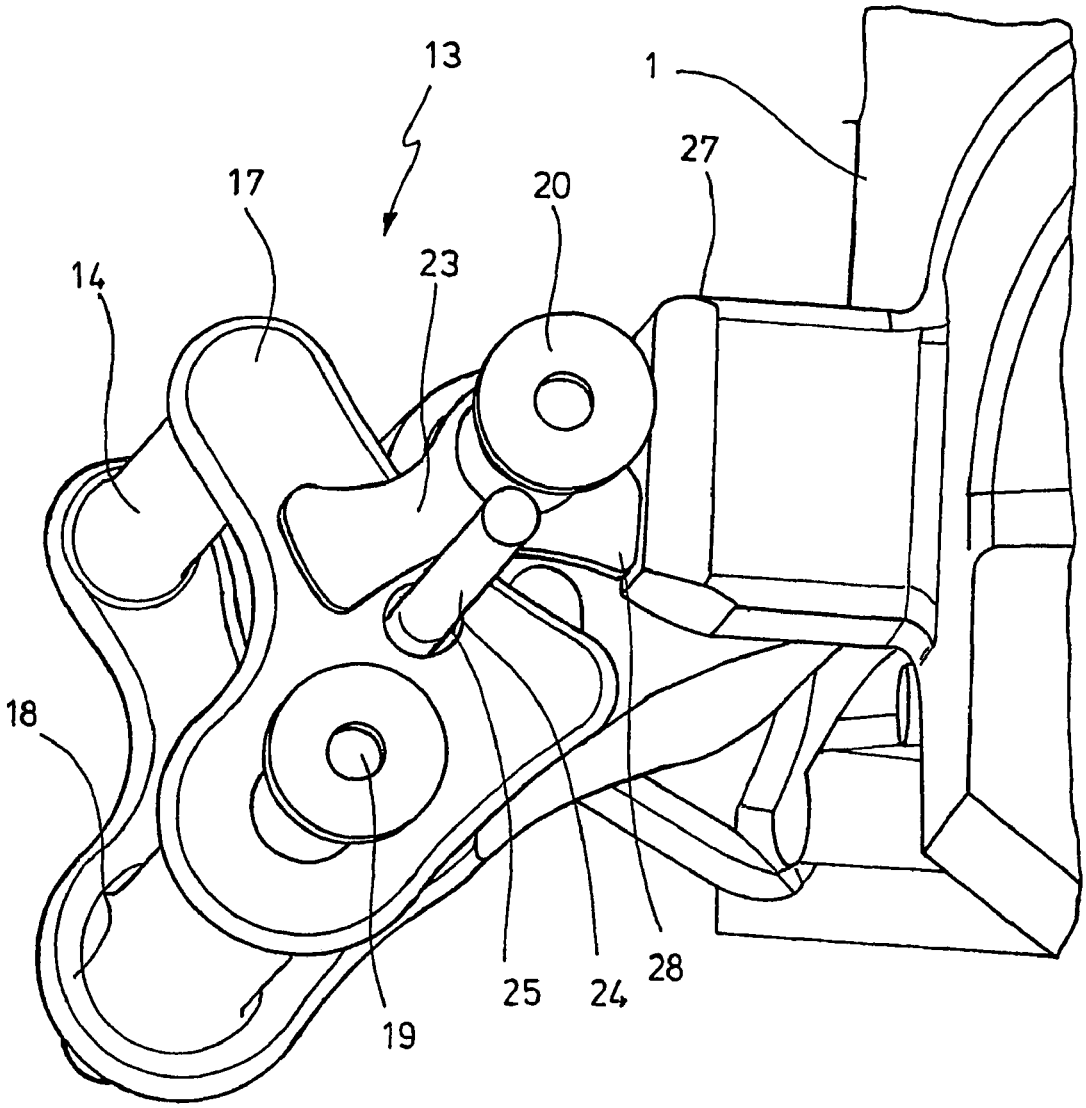
FIG. 6 shows a perspective top view of the fastener assembly.

FIG. 6 shows a top view of the fastener assembly 13. In the operating state shown here, the safety pin 24 is projecting out from the opening 25. The opening 25, however, has been released by the safety plate 23, which sends the signal that the door element 11 is in the position corresponding to the shut state.

The base element 1 comprises a stop block 27 for positioning the safety plate 23. When the door element 11 is moved . . . [into-JPD] . . . the shut position, the guide edge 28 of the safety plate 23 is moved against the stop block 27, and the safety plate 23 is thus pivoted in such a way that the opening 25 is released. Before the door element 11 is shut, the safety plate 23 covers the opening 25, and the safety pin 24 can therefore not be introduced into the opening 25.

Figure 7:
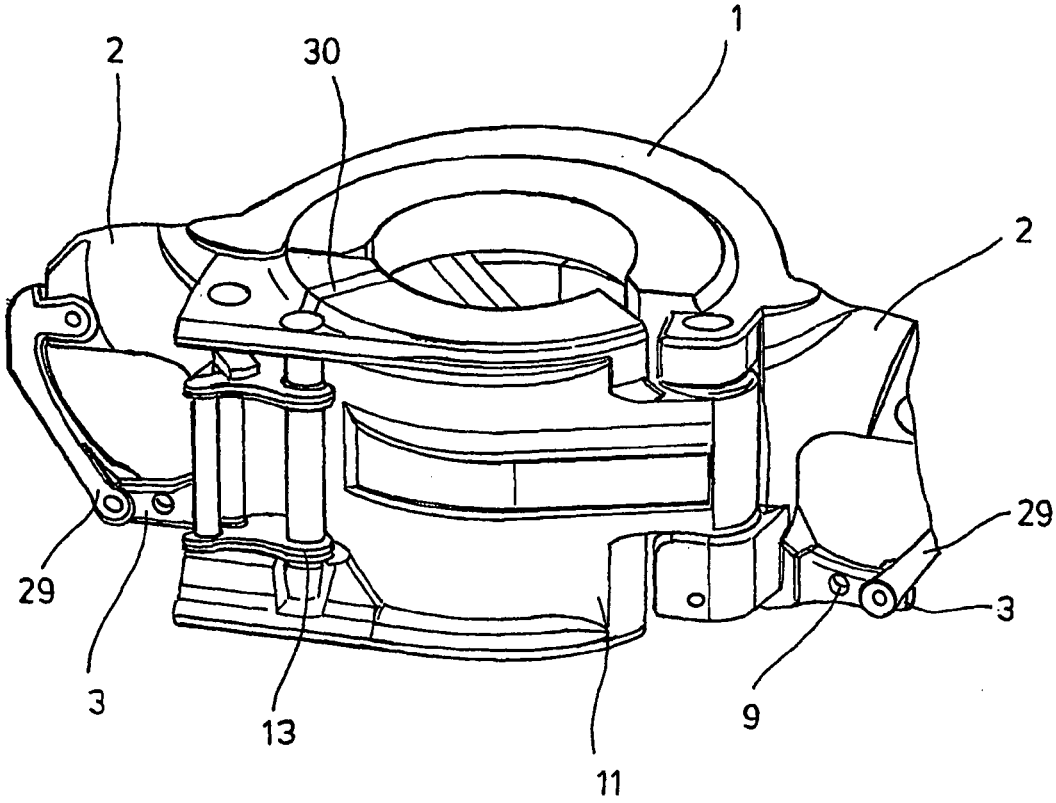
FIG. 7 shows another perspective view of the device, looking at the side of the door element.

FIG. 7 shows another perspective view of the device, looking laterally at the door element 11. It can be seen in this view that a securing shackle 29 is located in the area of each retaining element 2, 3. Two openings 9, furthermore, are provided in the area of the lower retaining elements 3. A positioning element (not shown), which is introduced between the retaining elements 2, 3 and is used in particular to position and to rotate the device, can be held in place by the securing shackles 29.

According to the embodiment in FIG. 7, the device is equipped with a self-locking feature 30. This can be used for the purpose of taking advantage of the pipe being held by the device to bring about the necessary locking action.

Figure 8:
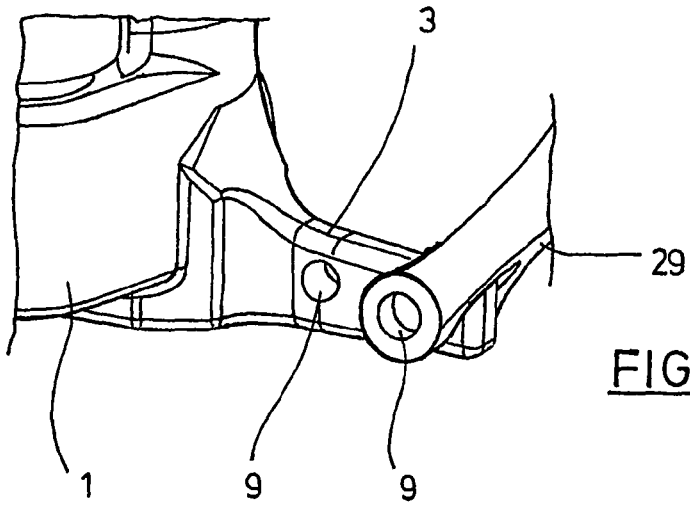
FIG. 8 shows an enlarged view in the area of a lateral retaining element of the base element.

FIG. 8 shows an enlarged view of the lower retaining element 3 with the two openings 9, located next to each other.

Figure 9:
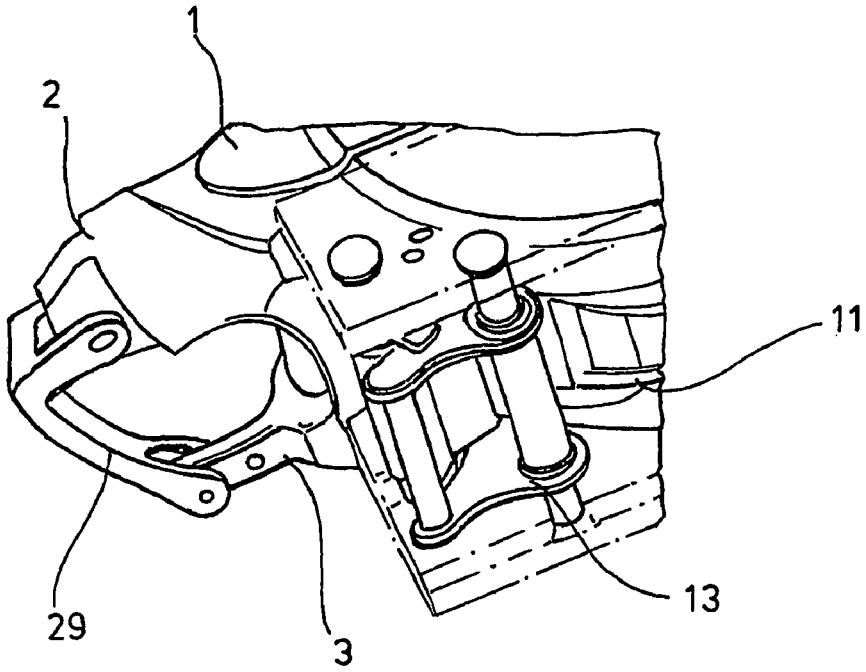
FIG. 9 shows a perspective partial view of the base element with two projecting retaining elements and of the fastener assembly.
Figure 10:
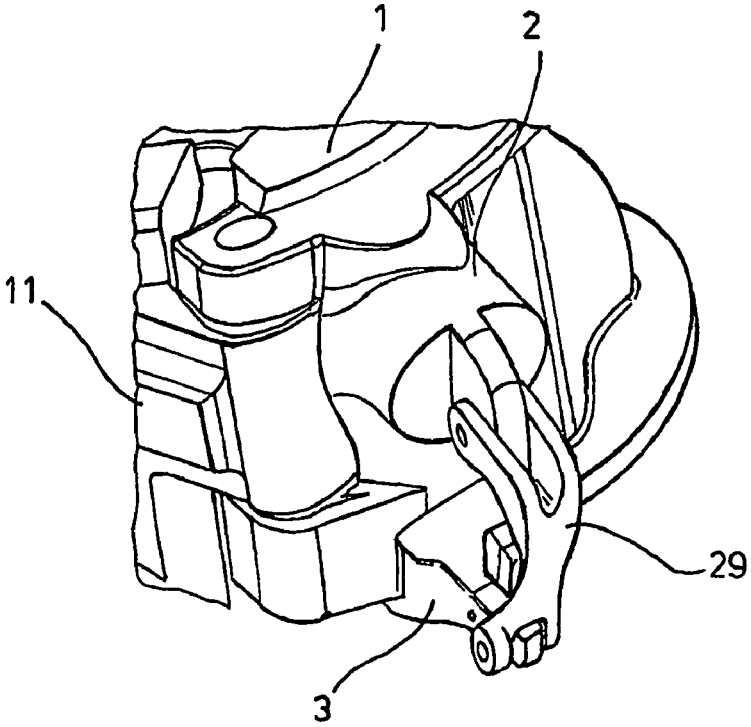
FIG. 10 shows a perspective view of two lateral retaining elements of the base element with their associated securing shackles.

In additional perspective views, FIG. 9 shows the arrangement of the fastener assembly 13, and FIG. 10 illustrates again the rounded design of the retaining elements 2, 3, which is intended to make it easier for the positioning element to introduce rotational movement into the holding device.

FIG. 11 again shows the fastener assembly 13 positioned in such a way that the safety pin 24 has been lowered into the opening 25. This sends the signal both that the door element 11 is shut and that the locking profile 15 is in the locking position.

Figure 11:
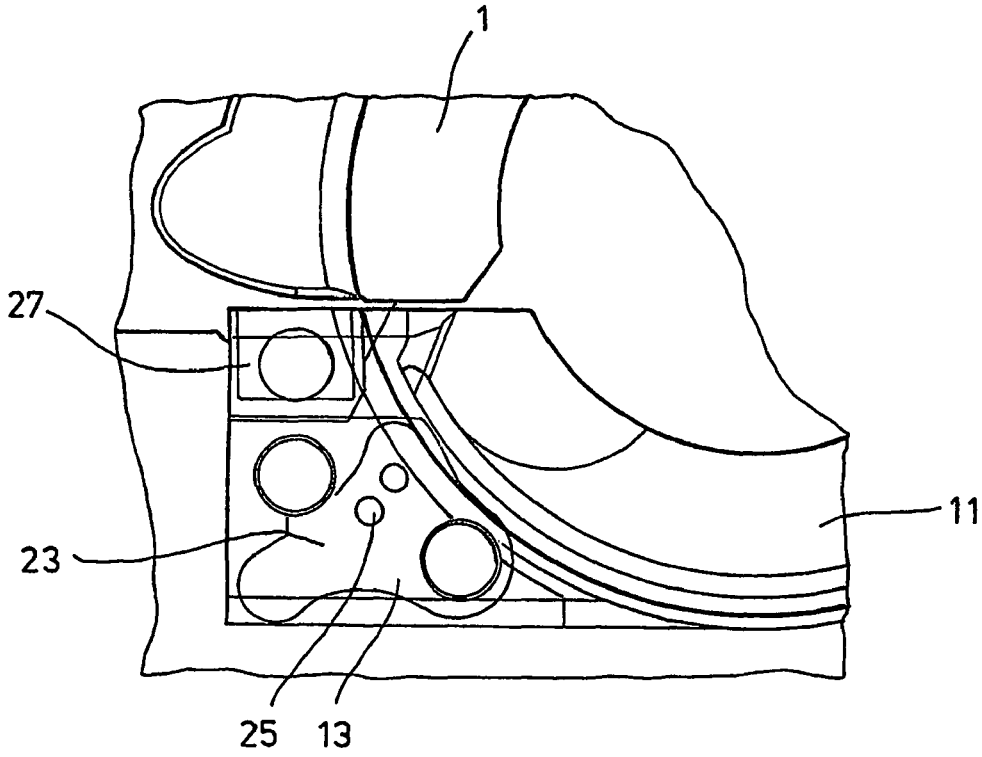
FIG. 11 shows a top view of the device in the area of the fastener assembly to illustrate a positioning of the safety pin when all of the locking elements are in their proper positions.
Figure 12:
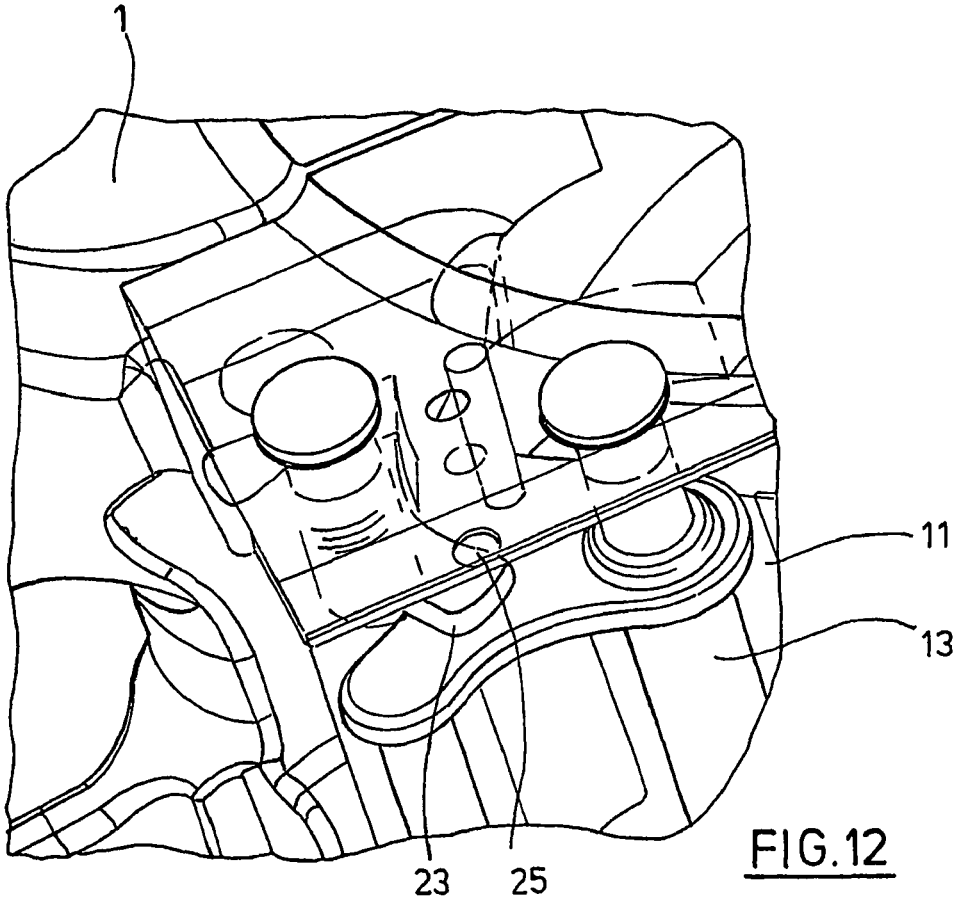
FIG. 12 shows a perspective view of the arrangement according to FIG. 11.

FIG. 12 shows a perspective view of the arrangement according to FIG. 11. Here, too, it can be seen that all the guides for the safety pin 24 are arranged in such a way that the safety pin 24 can be introduced and lowered.

Figure 13:
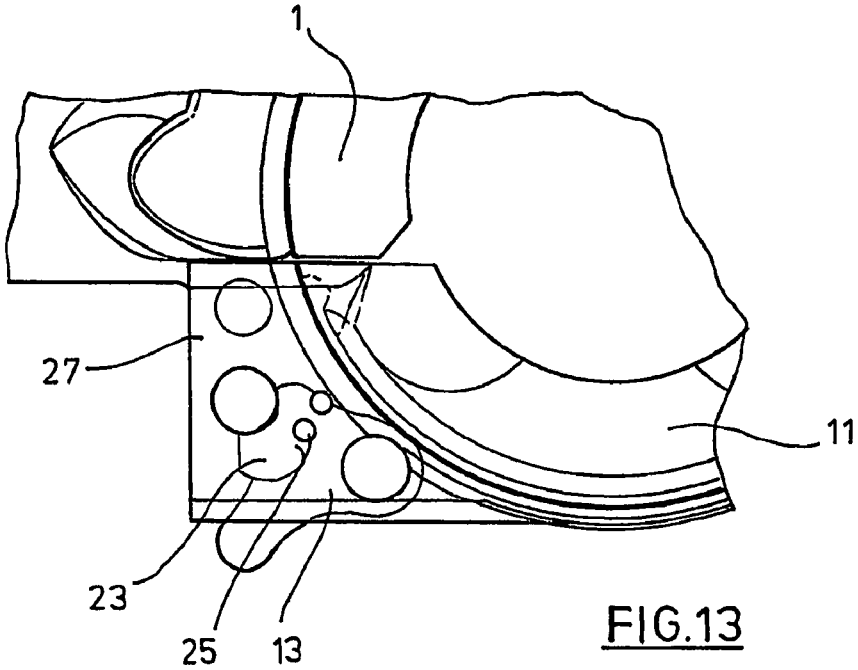
FIG. 13 shows the arrangement according to FIG. 11 in an incorrect operating state, in which, although the door element is shut, the locking profile has not assumed the closed position.
Figure 14:
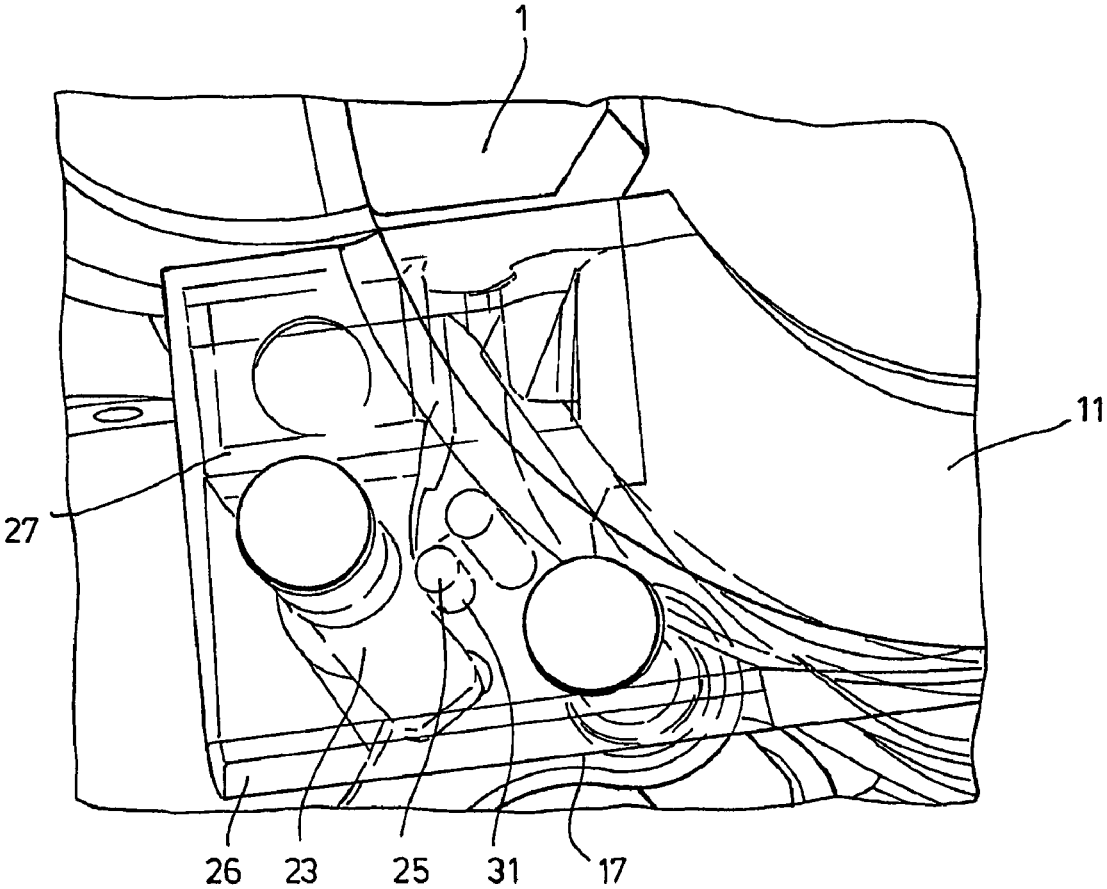
FIG. 14 shows a perspective view of the arrangement according to FIG. 13.

FIG. 13 shows an incorrect operating state in which, although the door element 11 is shut, the locking profile 5 is not gripping the locking pin 16 from behind. FIG. 14 shows an enlarged view of the arrangement of FIG. 13 in the area of the fastener assembly 13. Because of the connection between the grip 14 and the locking profile 15, the support plate 17 also fails to assume the position which corresponds to the correct locking position. As a result, the opening 25 in the carrier plate 26 and an opening 31 in the support plate 17 are not situated precisely one above the other, which means that the safety pin 24 cannot be introduced.

Figure 15:
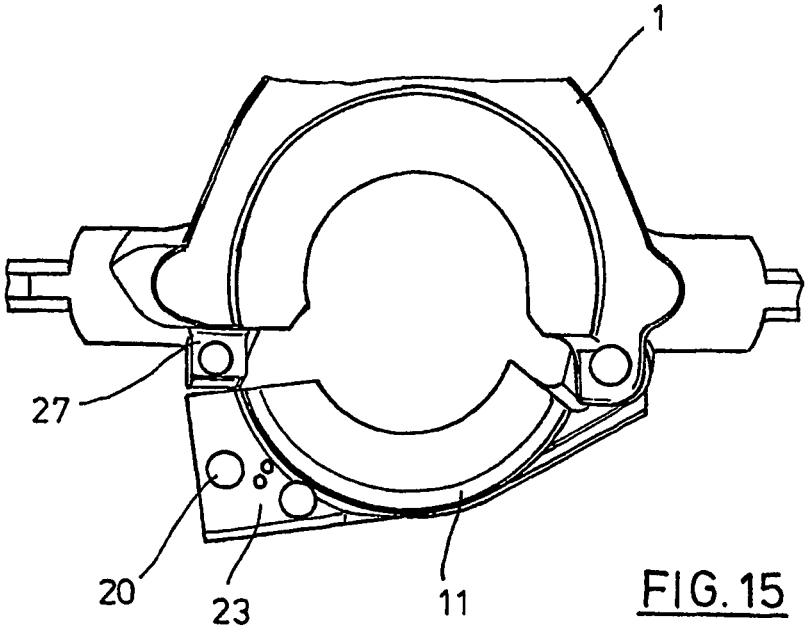
FIG. 15 shows the arrangement according to FIG. 11 in an operating state in which the locking profile is in the closed state, but the door element is not shut.
Figure 16:
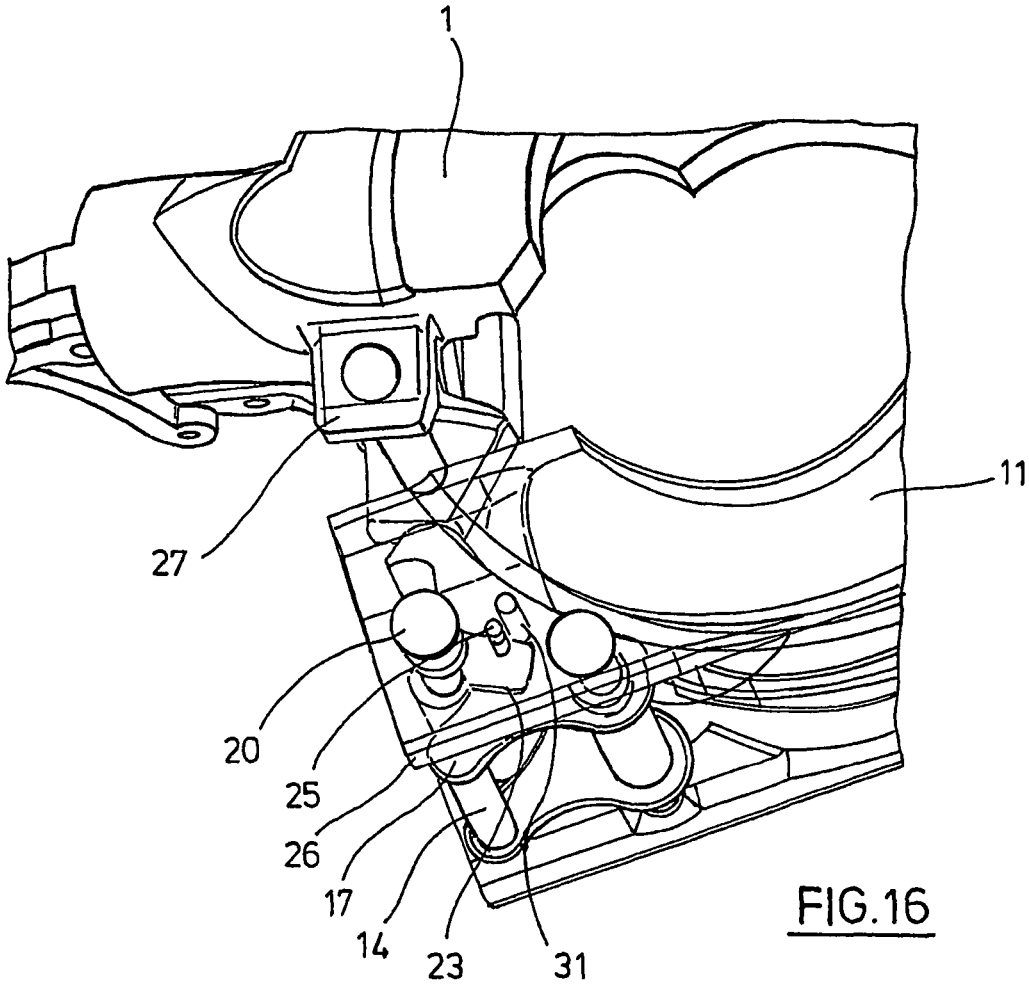
FIG. 16 shows a perspective view of the arrangement according to FIG. 15.

FIG. 15 shows an operating state in which, although the grip 14 and the locking profile 15 are in their proper closed positions relative to the door element 11, the door element 11 itself is not shut. FIG. 16 shows an enlarged view of the operating state according to FIG. 15 in the area of the fastener assembly 13. It can be seen in particular that the stop block 27 is not in contact with the safety plate 23, and as a result the safety plate 23 is pivoted relative to the secondary axis 20 in such a way that at least part of at least one of the openings 25, 31 is covered. As a result, the safety pin 24 cannot be introduced completely and projects from the carrier plate 26.

Figure 17:
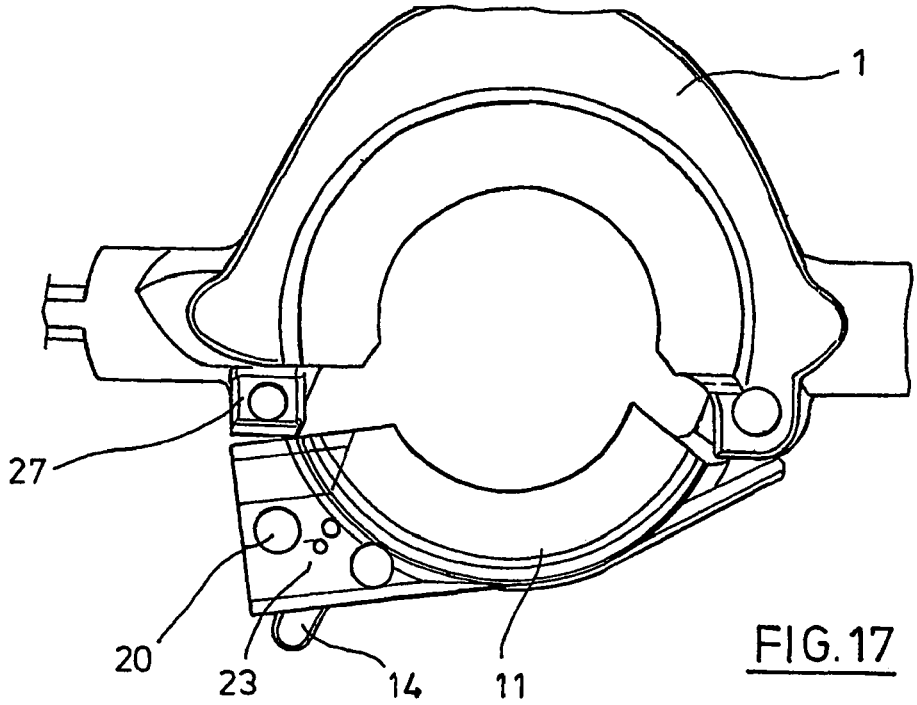
FIG. 17 shows the arrangement according to FIG. 11 in an incorrect operating state, in which the door element is not shut and the locking profile has not assumed its closed position.
Figure 18:
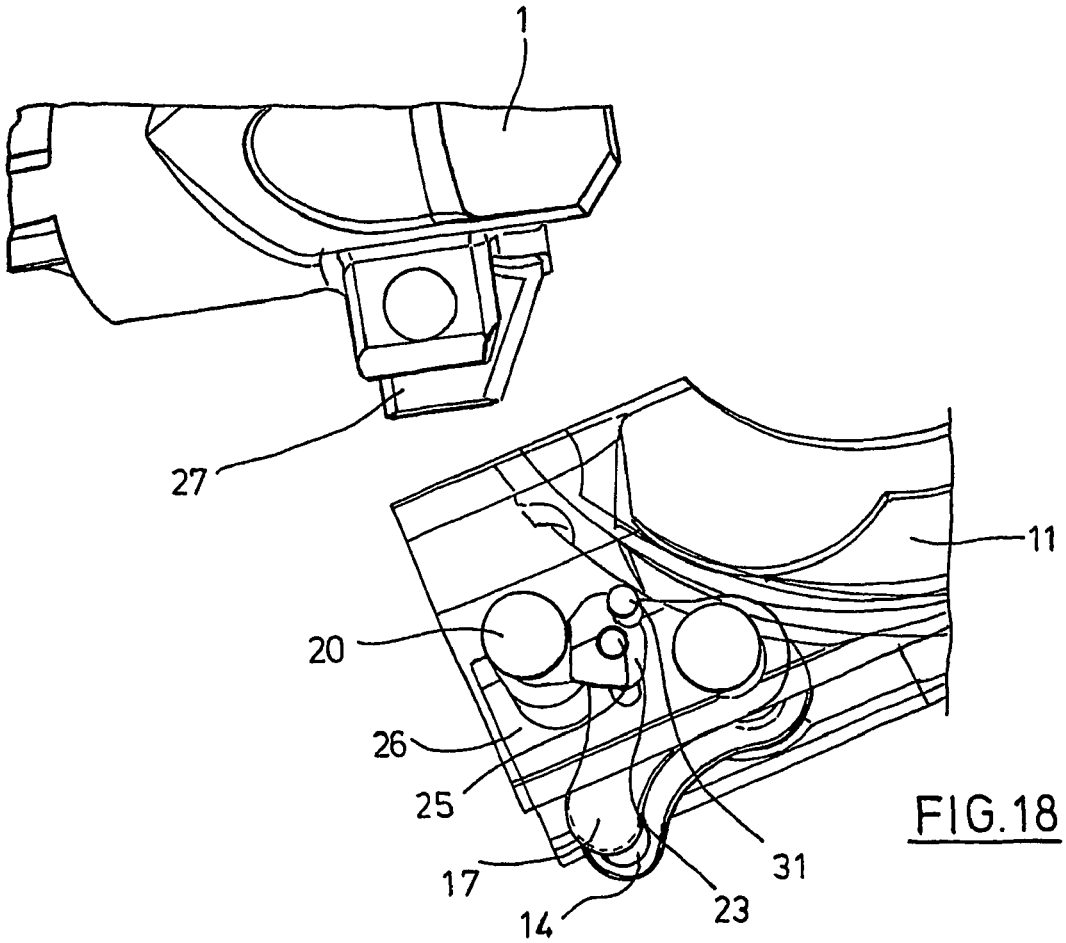
FIG. 18 shows a perspective view of the arrangement according to FIG. 17.

FIG. 17 shows an operating state in which the door element 11 is not shut, nor has the fastener assembly 13 assumed a locking position relative to the door element 11. FIG. 18 shows an enlarged view of the operating state according to FIG. 17 in the area of the fastener assembly 13. It can be seen that the openings 25, 31 are not situated directly one above the other, nor has the opening 25 been released by the safety plate 23. It is therefore impossible to introduce the safety pin 24 In this operating state as well.

The invention claimed is:

1. A device for vertically holding pipes, which comprises a base element in the form of a segment of a cylinder, a door element pivotably connected to the base element by at least one pivot joint, and a fastener assembly mounted opposite the pivot joint, wherein the fastener assembly (13) has a pivotable catch with a locking profile (15) which, when in the locked state, grips a locking pin (16) from behind, where a safety pin (24) and a safety plate (23) are located in the area of the pivotable catch, and where, depending on its position, the safety plate (23) releases or closes at least one opening (25, 31) for the safety pin (24), wherein the locking pin (16) is held by the base element (1).

2. A device according to claim 1, wherein the base element (1) and the door element (11) with the fastener assembly (13) are provided for use on oil drilling platforms.

3. A device according to claim 1, wherein the base element (1) and the door element (11) with the fastener assembly (13) are designed to hold drill pipes.

4. A device according to claim 1, wherein the safety pin (24) and the safety plate (23) are held by the door element (11).

5. A device according to claim 1, wherein both the locking profile and the safety plate (23) are mounted so that they can pivot relative to a secondary axis (20).

6. A device according to claim 1, wherein one of the openings (25, 31) for the safety pin (24) is located in a carrier plate (26), which supports the fastener assembly (13) and is rigidly connected to the door element (11).

7. A device according to claim 6, wherein a support plate (17, 18), which is connected to the locking profile (15) and holds a grip (14), is provided with an opening (31) for the safety pin (24) and is supported so that it can rotate relative to a central axis (9).

8. A device according to claim 7, wherein the support plate (17, 18) can be positioned in various ways as a function of the closing state present at the time.

9. A device according to claim 7, wherein the grip (14) is connected to the locking profile (15) by a connecting profile held by the support plate (17, 18).

10. A device according to claim 7, wherein the grip (14) is designed as a pivoted lever.

11. A device according to claim 7, wherein the grip (14) is designed as a pull-handle.

12. A device according to claim 8, wherein, in the properly closed state, the opening (25) in the area of the carrier plate (26) and the opening (31) in the area of the support plate (17) are coaxial to each other, one lying directly above the other, and where, in the closed state the openings (25, 31) are released by the safety plate (23).

13. A device according to claim 1, wherein the safety plate (23) can be positioned as a function of the relative positioning between the base element (1) and the door element (11).

14. A device according to claim 13, wherein the safety plate (23) is mounted so that it is free to pivot.

15. A device according to claim 13, wherein the safety plate (23) is mounted so that it is free to shift position.

16. A device according to claim 13, wherein the safety plate (23) can be positioned by a stop block (27) of the base element (1).

17. A device according to claim 1, wherein the safety pin (24) can be positioned by contact with the pipe that is being held.

18. A device according to claim 1, wherein the base element (1) is provided on the outside with at least one retaining element (2, 3).

19. A device according to claim 18, wherein the base element (1) comprises at least two retaining elements (2, 3) arranged opposite each other.

20. A device according to claim 18, wherein the retaining elements (2, 3) are designed as web-like parts and a have projections arranged a certain distance apart.

21. A device according to claim 18, wherein the retaining elements (2, 3) are arranged one above the other in the longitudinal direction (4).

22. A device according to claim 18, wherein at least certain areas of the retaining elements (2, 3) comprise rounded external contours.

23. A device according to claim 18, wherein at least certain areas of the retaining elements (2, 3) are provided with contact surfaces (6, 7), by which they establish a connection with a positioning element.

24. A device according to claim 18, wherein the retaining elements (2, 3) are provided with at least one opening (8, 9).

* * * * *